US009039264B2

(12) United States Patent
Martini

(10) Patent No.: US 9,039,264 B2
(45) Date of Patent: May 26, 2015

(54) ORNAMENT WITH ENCLOSED WATER-PROOF BATTERY CAPSULE

(75) Inventor: Richard Martini, Chicago, IL (US)

(73) Assignee: New Tsai Capital, LLC, Chicago, IL (US)

( * ) Notice: Subject to any disclaimer, the term of this patent is extended or adjusted under 35 U.S.C. 154(b) by 522 days.

(21) Appl. No.: 13/488,130

(22) Filed: Jun. 4, 2012

(65) Prior Publication Data

US 2013/0322064 A1 Dec. 5, 2013

(51) Int. Cl.

| | |
|---|---|
| ***A47G 35/00*** | (2006.01) |
| ***A47G 33/08*** | (2006.01) |
| ***F21L 4/02*** | (2006.01) |
| ***F21S 10/02*** | (2006.01) |
| ***F21V 33/00*** | (2006.01) |
| *F21Y 101/02* | (2006.01) |

(52) U.S. Cl.

CPC . *F21L 4/02* (2013.01); *A47G 33/08* (2013.01); *A47G 2033/0827* (2013.01); *F21S 10/023* (2013.01); *F21V 33/008* (2013.01); *F21Y 2101/02* (2013.01)

(58) Field of Classification Search

CPC ..... A47G 2033/0827; A47G 33/08; F21S 10/023; F21Y 2101/02

USPC ..... 362/311.13, 564, 565, 568, 644, 806

See application file for complete search history.

(56) References Cited

U.S. PATENT DOCUMENTS

| | | | | |
|---|---|---|---|---|
| 3,873,880 | A * | 3/1975 | Riddell | 315/53 |
| 4,652,980 | A * | 3/1987 | Segan | 362/86 |
| 5,772,312 | A | 6/1998 | Pihl-Niederman | |
| 5,865,533 | A * | 2/1999 | Liu | 362/583 |
| 5,957,564 | A | 9/1999 | Bruce | |
| 6,053,620 | A | 4/2000 | Won | |
| 6,547,414 | B2 | 4/2003 | Steger | |
| 2008/0089075 | A1 * | 4/2008 | Hsu | 362/363 |
| 2009/0191787 | A1 | 7/2009 | Rubinstein | |

OTHER PUBLICATIONS

Patent Cooperation Treaty, International Preliminary Report on Patentability, International application No. PCT/US13/43852, Jul. 28, 2014.

Patent Cooperation Treaty, International Search Report (PCT Article 18 and Rules 43 and 44), International application No. PCT/US13/43852, Oct. 8, 2013.

* cited by examiner

*Primary Examiner* — Andrew Coughlin

(74) *Attorney, Agent, or Firm* — Flachsbart & Greenspoon, LLC

(57) ABSTRACT

A decorative ornament capable of being completely illuminated about its surface including a hollow shell comprising a water-proof battery capsule is described. When the ornament is on display, the battery capsule is stored in a hollow shell of the ornament, in a manner such that only the removable lid of the battery capsule is visibly exposed. A battery pack, comprising one or more batteries, provides the power to illuminate the ornament and is enclosed within the battery capsule. The ornament surface is made using a water-resistant material. The battery capsule is made of a similar water-proof material and is sealed so as to prevent the battery pack from malfunctioning during various weather conditions. The battery pack's configuration enables the ornament to comprise a plurality of lighting modes, including full-on, blinking-on, and timer. The ornament can be displayed indoors or outdoors, and may be used year after year.

20 Claims, 8 Drawing Sheets

ORNAMENT WITH ENCLOSED WATER-PROOF BATTERY CAPSULE

FIELD OF THE INVENTION

The present invention relates to an ornament capable of being completely illuminated about its surface, comprising an enclosed water-proof battery capsule within the ornament's hollow shell enclosing a battery pack, that is capable of being displayed outside for long periods of time in various adverse weather conditions, wherein the ornament has a plurality of lighting modes which can include full-on, blinking-on, and timer.

BACKGROUND OF THE INVENTION

Illuminated decorations have long been used to celebrate the holiday season. In particular, the presence and display of light strings, ornaments, and other illuminated decorations is an indicator that the holiday season has arrived, and creates a feeling of nostalgia. Christmas is most well known for being the time when lighted decorations are used, although lights are also traditionally used during other holidays such as Halloween and New Years. Lights and illuminated ornaments are used by themselves but are also presented together with other non-illuminated decorative elements.

Holidays are not the only time people use lighted strings and ornaments for decorative effect. For example, light strings are often placed on or near trees, buildings, lampposts, sidewalks of major thoroughfares, store windows, and other general places of assembly such as ice skating rinks Thus, lights and illuminated ornaments are used for decoration purposes all year round, both indoors and outdoors.

There are various kinds of illuminated decorations. The lights can be assembled on a string with each light a fixed distance apart from the next light. Alternatively, the decoration can be a lighted ornament. An ornament can itself be any number of things, including spheres or cubes, animals or animal-like characters (e.g., Santa Claus, elves, reindeer, snowmen, etc.) or any number of objects (e.g., sleds, trees, candy canes, etc.).

Traditionally, the lights and lighted decorations can have different lighting modes. For instance, instead of the lights being continuously illuminated, they can also be blinking on and off at set time increments. Additionally, the lights can be configured using a timer, such that they are on continuously or blinking but then set to turn off after a fixed number of minutes or hours. This way the lights can be used as decoration during the evening, but then are set to turn off after several hours to conserve energy.

Several configurations of ornament displays are possible. The ornaments themselves can be illuminated by being comprised of several lights or by just one light. Ornaments can have different sizes. If spherical, the ornaments can range from about the size of a golf ball (1.7 inches in diameter) to as large as a cage ball (72 inches in diameter) and everywhere in between (baseball, volleyball, basketball) although they can be larger or smaller and can be any shape. The corresponding triangular or rectangular ornaments can be of that approximate size as well.

The source of power for these lights, if not plugged into an electrical outlet, is typically a battery or battery pack comprising one or more batteries. Ornaments with exterior battery packs are known, but they have a form factor that can be difficult to handle, and are not aesthetically pleasing.

U.S. Pat. No. 5,772,312 describes an ornament containing a hollow shell such that lights are placed inside of the ornament in order to illuminate the ornament. The ornament is powered using conventional AC power from a wall outlet. U.S. Pat. No. 6,053,620 describes an improvement of a water-draining passage structure of a lamp set for an ornament. While '620 describes a water-draining passage structure, it does not describe a water proof ornament containing a water-proof battery capsule comprising a battery pack whose configuration enables a plurality of lighting modes. U.S. Pat. No. 6,547,414 describes an underwater flashlight comprising a water-proof battery pack which can be removably changed underwater. While '414 describes a flashlight containing a water-proof battery pack, it does not describe an illuminated decorative ornament comprising a water-proof battery capsule comprising a battery pack which enables various lighting configurations including full-on, blinking-on, and timer.

SUMMARY OF THE INVENTION

The present invention relates to a unique illuminated ornament that houses a water-proof battery capsule containing a battery pack which enables a plurality of lighting modes. The battery pack consists of one or more batteries. The ornament is adorned with a plurality of light bulbs which may be secured to the shell through light bulb apertures on an exterior surface. The light bulbs can be any number of colors. The ornament can be further adorned with a plurality of translucent member decorations corresponding to each light bulb. The translucent member decorations may be secured to the exterior surface of the shell to permit light generated by the light bulbs to shine with an embellished appearance from the ornament. The ornament can be displayed indoors or outdoors using the battery pack as a source of power, the battery pack being housed within a water-proof battery capsule. The water-proof battery capsule protects the battery pack from rain, snow and extreme temperatures. Further, the battery pack's associated circuitry enables a multitude of lighting modes, including but not limited to full-on, blinking-on, and timer. Full-on mode illuminates the ornament continuously, blinking-on illuminates the ornament on and off after set time increments, and timer illuminates the ornament either full-on or blinking-on for a set number of minutes or hours, after which the ornament ceases being illuminated. Preferably, the present invention concerns an ornament that contains a water-proof battery capsule comprising a battery pack enabling a plurality of lighting modes, and is to be used together with similarly structured ornaments.

DETAILED DESCRIPTION OF THE PREFERRED EMBODIMENTS

The present invention is directed to an ornament which employs a hollow shell to house a water-proof battery capsule containing a battery pack used as a power source to illuminate the light bulbs and to enable a plurality of lighting modes including full-on, blinking-on and timer.

Figure 1:
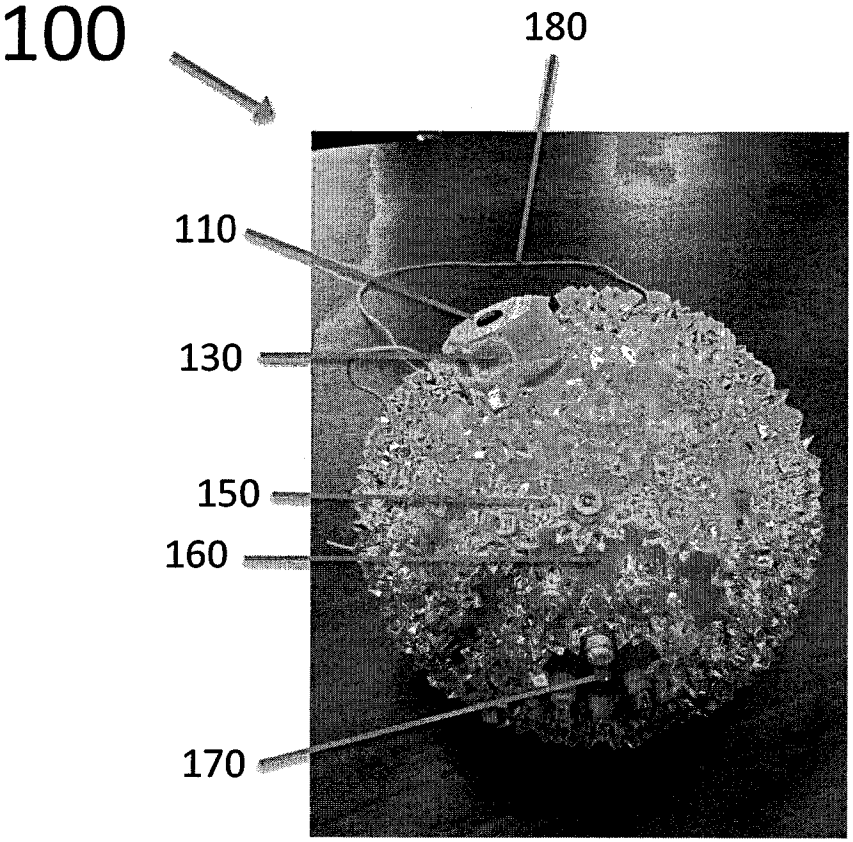
FIG. 1 is a side view of an example spherical ornament in a closed arrangement containing an enclosed water-proof battery capsule.

As is shown in FIG. 1, one preferred spherical ornament 100 consistent with the present invention is embellished with a plurality of decorated light bulbs 170. The light bulbs are typically either incandescent or light emitting diodes. In this embodiment, the spherical ornament 100 is comprised of one hundred two such light bulbs 170, and the light bulbs 170 are each themselves decorated with a translucent member decoration 150. The translucent member decorations 150 serve as aesthetic enhancement but also enhance the illuminative effect of the light bulbs 170. The spherical ornament 100 is shown in a closed arrangement with the water-proof battery capsule 110 enclosed inside, although the removable battery capsule lid 130 is optionally visible. The water-proof battery capsule 110 can be designed to complement the shape of the ornament, although this is not required. For example, if the battery pack comprises cylindrical batteries, and the ornament is cube-shaped, then the battery capsule tube 135 may be cylindrical while the capsule lid 130 rectangular so as to complement visually and structurally the cube-shaped ornament. In the present example, the battery capsule 110 is cylindrically shaped with a circular battery capsule lid 130 such that the top of the lid 130 visually and structurally complements the shape of the example spherical ornament 100. The type (e.g., size) of battery pack used will depend on the size of the ornament. As such, the battery pack's life can vary anywhere between two weeks to six months. The battery capsule 110 can accommodate a battery pack comprising one or more batteries.

In this example, the water-proof battery capsule 110 is made out of the same water proof plastic material as the ornament surface 160, and lid 130 makes a water-impregnible seal when engaged (e.g., as a screw top). However, this material is not limited to plastic material, and may be any water proof material allowing the spherical ornament 100 to be displayed outdoors in a variety of weather conditions. Other examples of such water-resistant material include rubber and resin impregnated fiber. The ornament surface 160 is thick enough (greater than 0.1 mm) so that the ornament is both water-proof and durable. The ornament surface 160 may be in festive colors such as red and green for Christmas or orange and black for Halloween. The spherical ornament 100 also comprises a fastening wire 180, which serves to fasten the ornament in a closed arrangement. The fastening wire 180 can also be used to hang the ornament from a suspended structure and/or to attach the ornament to other like ornaments. Lid 130 may alternatively use a quick-release construction, such as a spring-engaged button, for greater ease of consumer access and battery replacement. Pushing the button may pop out the battery compartment, which may then be popped back in against the spring tension, resetting the button.

Figure 2:
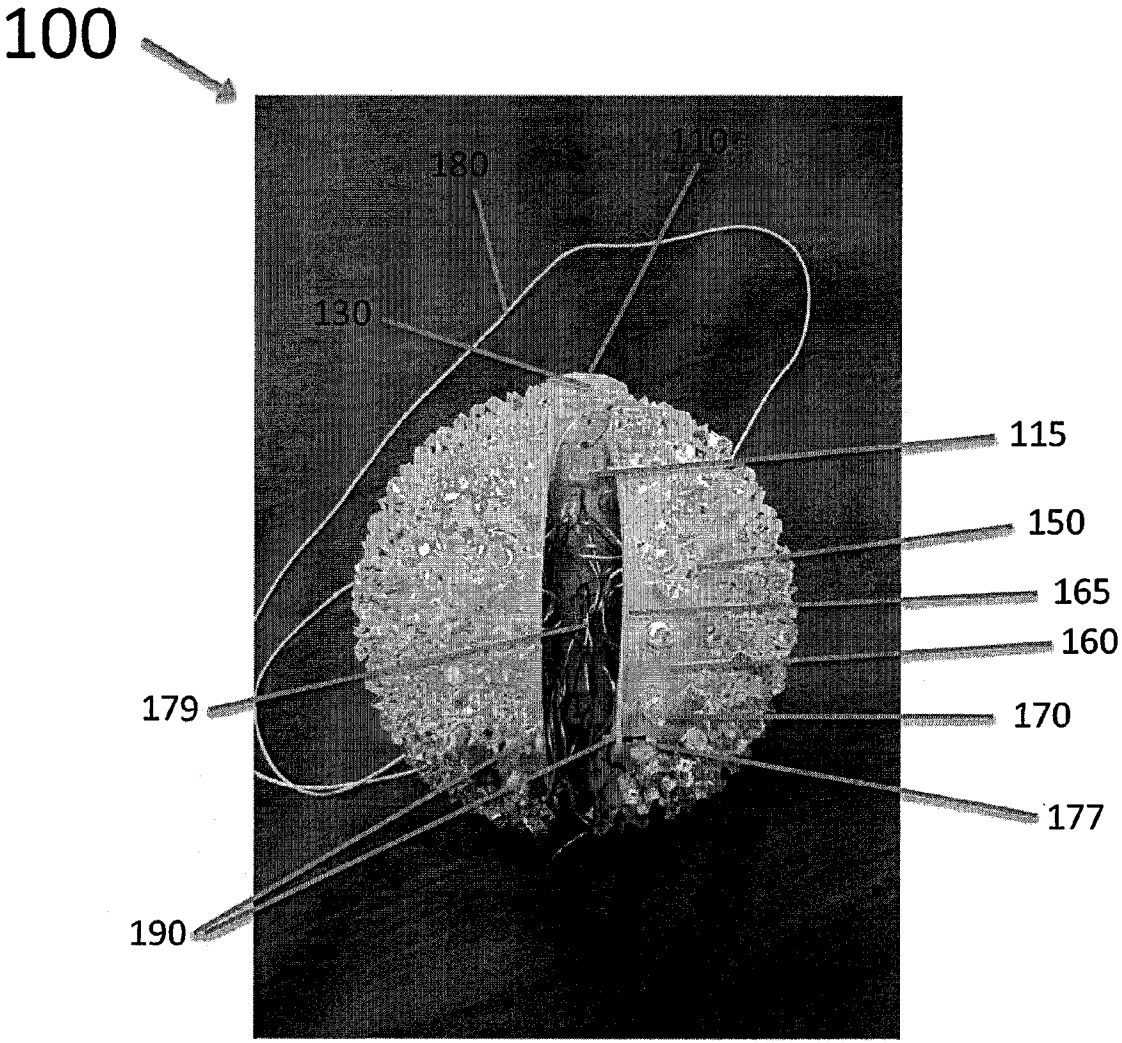
FIG. 2 is a side view of the example spherical ornament in a partially open arrangement shown with the water-proof battery capsule inside.

FIG. 2 shows the example spherical ornament 100 in a partially open arrangement. The example spherical ornament 100 contains several ornament connectors 190 that permit the example spherical ornament 100 to be fastened together. The ornament is typically comprised of two halves. Thus, the example spherical ornament 100 contains an ornament half indicator 165 that protrudes slightly (approximately 0.5 mm) from the ornament surface 160. When in a closed arrangement, the two halves of the ornament are fastened via the ornament connectors 190 using either an ornament tie 177 or a fastening wire 180, either of which will run through the ornament connector apertures 195, which are shown in more detail in FIG. 5. FIG. 2 further shows electrical wire 179 which connects to and serves to illuminate the plurality of light bulbs 170. An optional gasket may be used at the seam between the halves.

Figure 3:
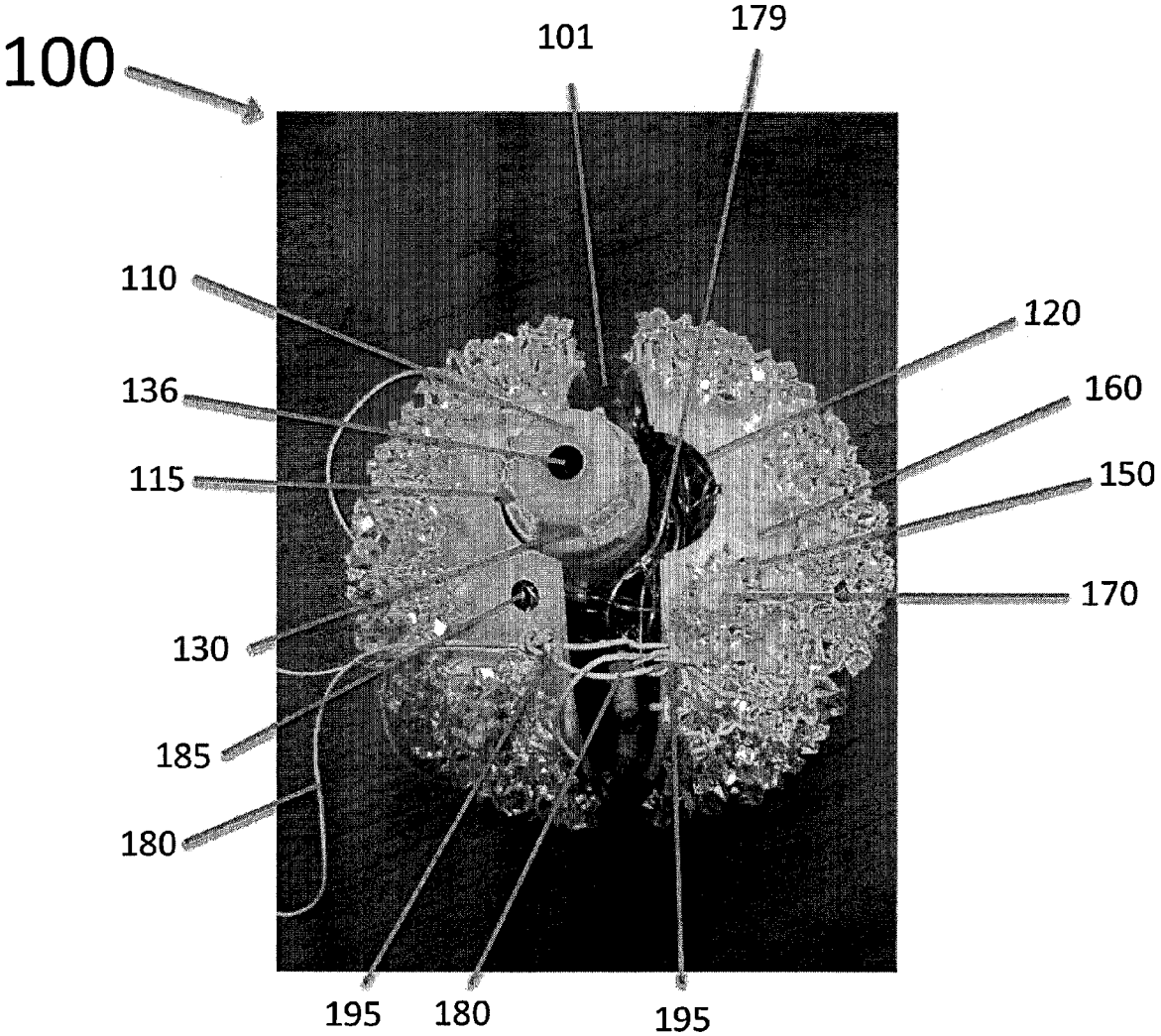
FIG. 3 is a top view of the example spherical ornament in a partially open arrangement shown with the water-proof battery capsule inside.

FIG. 3 shows a top view of the example spherical ornament 100. The battery capsule 110 is housed in the hollow shell 101 of the ornament 100. The light bulbs 170 are placed in the light bulb apertures 185 while the ornament is being displayed. Several such light bulb apertures 185 are located on the ornament surface 160 typically at equally spaced distances apart from each other. In the example spherical ornament 100 shown in FIG. 3, there are one hundred two such apertures 185, one for each light bulb 170. A light bulb 170 protrudes through each such light bulb aperture 185. In the example spherical ornament 100, they are separated, approximately, by 1 inch. The light bulbs 170, when lit, illuminate the entire ornament. Further in this example, a translucent member decoration 150 is placed around every light bulb 170 at every light bulb aperture 185. FIG. 3 further shows a capsule accommodation 120 of approximately the same radius as the water-proof battery capsule 110, allowing the capsule 110 to fit inside the ornament while the battery capsule lid 130 is exposed while still complementing visually and structurally the ornament surface 160. Also shown in FIG. 3 is a fastening wire 180 tied through the ornament connector apertures 195. The fastening wire 180 is long enough to pass through the ornament connector apertures 195 and still has enough length to suspend the ornament from a ceiling or connect to other ornaments. A button activator 136 exists on the capsule lid 130 for a user to toggle between different lighting modes.

Figure 4:
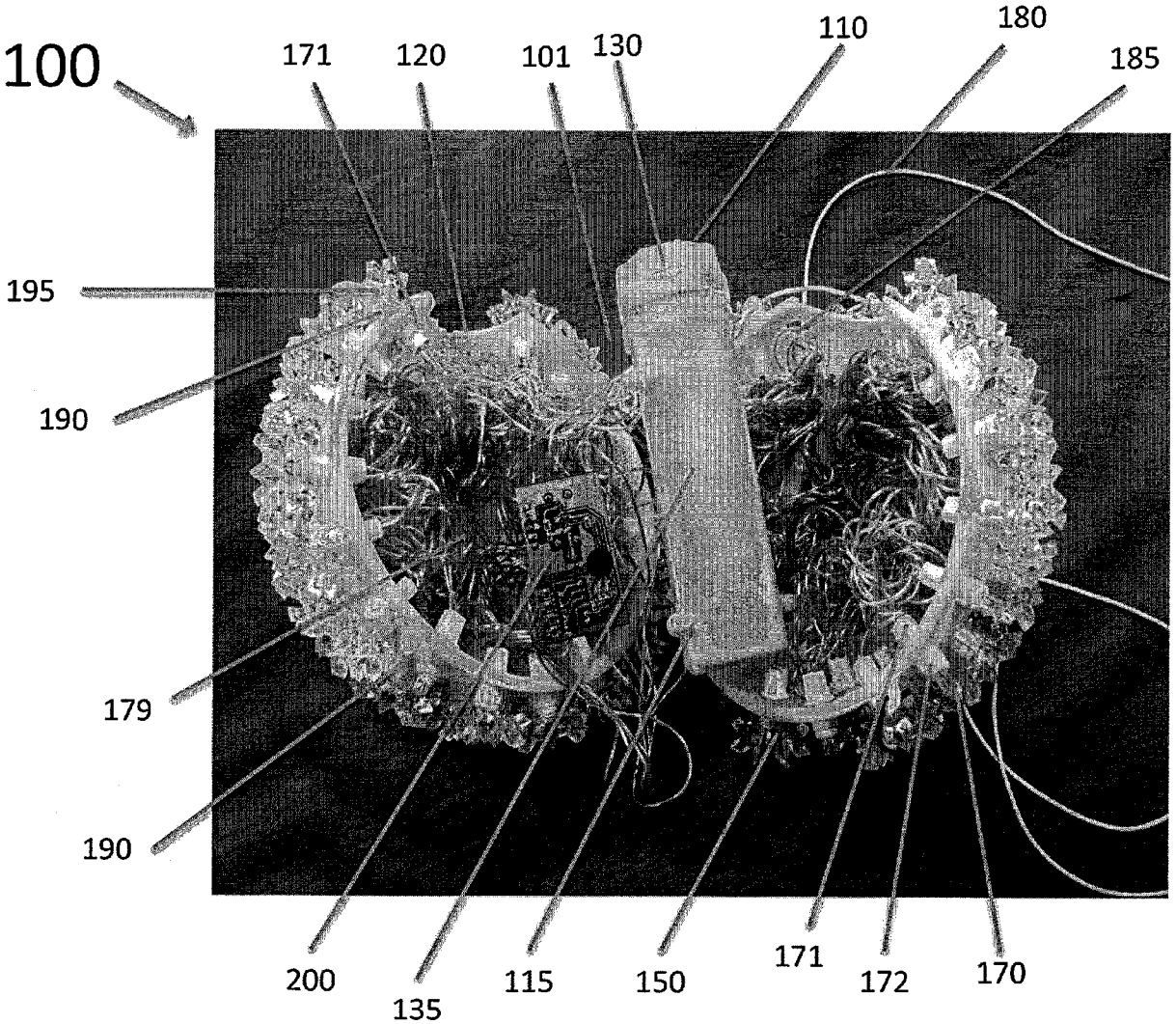
FIG. 4 is a side view of the example spherical ornament in a fully open arrangement shown with its contents.

FIG. 4 shows the ornament in an open arrangement. A circuit board 200 is used in the conventional manner to route electrical current from the battery to the plurality of light bulbs 170 via the electrical wire 179. The circuit board is approximately 4 inches lengthwise by 2 inches, or small enough to fit into the hollow shell 101 of the ornament 100. The entirety of the electrical wire 179 is housed in the hollow shell 101 of the water-proof spherical ornament 100. When the example spherical ornament 100 is in an open arrangement, the water-proof battery capsule tube 135 is visible. The battery capsule's 110 size will vary proportionately to the size of the ornament. In this example, the capsule 110 is about 7 inches long with a ¾ inch radius. The battery capsule lock clasps 115 join the halves of the battery capsule 110 together. FIG. 4 also shows the light bulb interior casing 171 and light bulb exterior casing 172. Typically four of the electrical wires will route through the underside of the interior casing 171 through the interior casing apertures 175 (shown in FIG. 5), two through each interior casing aperture 175.

Figure 5:
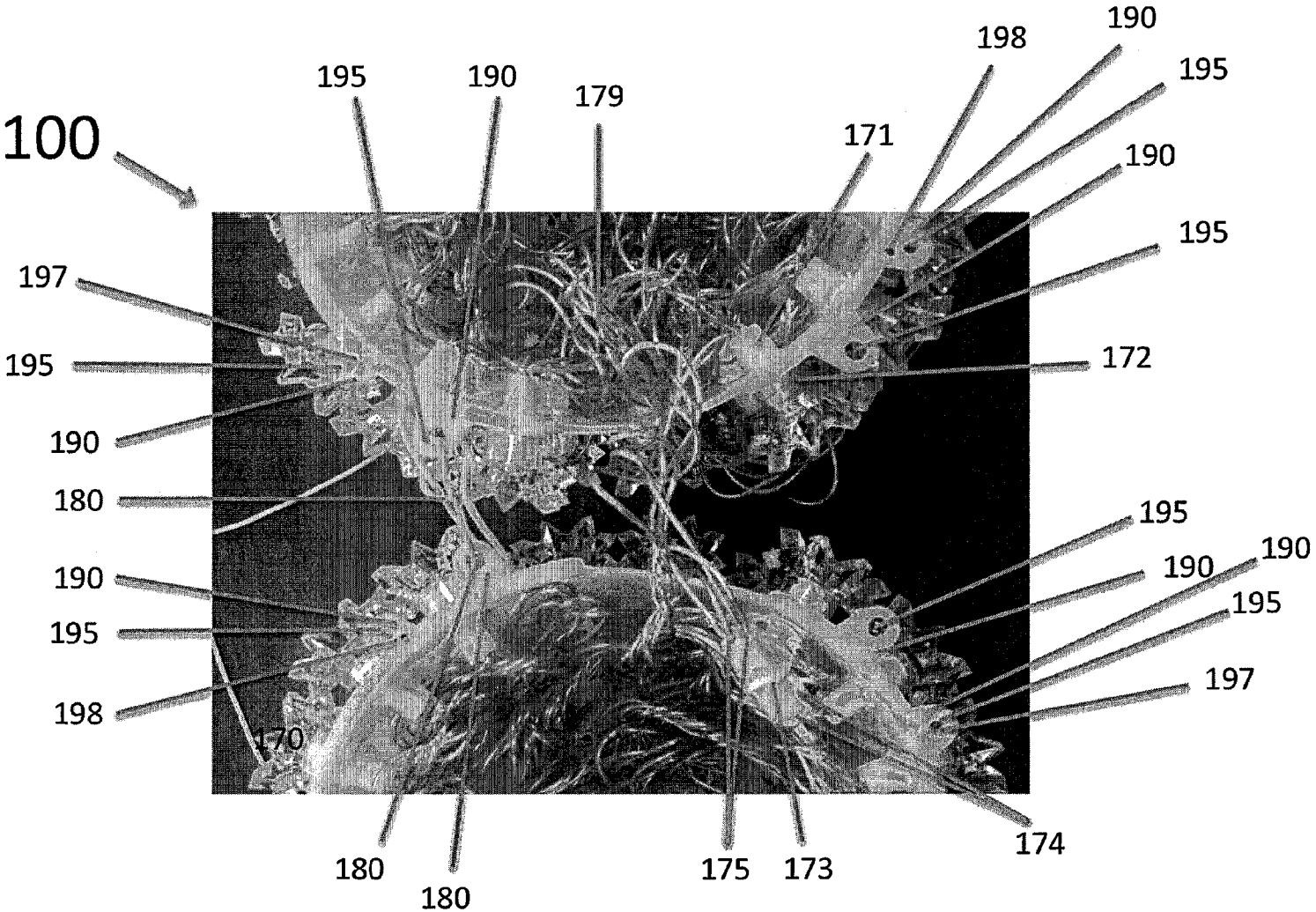
FIG. 5 is a close-up side view of the spherical ornament in an open arrangement.

The ornament connectors 190 can bee seen in more detail in FIG. 5. In addition to having an ornament connector aperture 195, some of them can have ornament connector pegs 197 and corresponding peg apertures 198. The pegs 197 are inserted into the peg apertures 198 when the ornament is closed. In this way, the pegs 197 and corresponding peg apertures 198 fasten the halves of the ornament together and ensure that the two halves are perfectly aligned when the ornament is in a closed arrangement. The ornament connectors 190 themselves can vary in size as some can be slightly smaller than the others, the smaller ornament connectors 190 typically being the ones that contain the pegs 197 and peg apertures 198.

FIG. 5 shows the electrical wire 179 being routed into the light bulb interior casing 171 via the interior casing apertures 175 through the light bulb exterior casing 172 and ultimately to the light bulbs 170. An interior casing ring 173 separates the interior 171 and exterior 172 casing. Importantly, the ring 173 serves to secure both interior 171 and exterior 172 casings against the bottom of the ornament surface 160. Other manners of retaining the light bulbs in the shell may include rubber gaskets, clips, or any other mechanisms which would allow the light bulbs to be secured on the ornament surface. The exterior casing furrows 174 secure the translucent member decorations 150 to the light bulbs 170.

Figure 6:
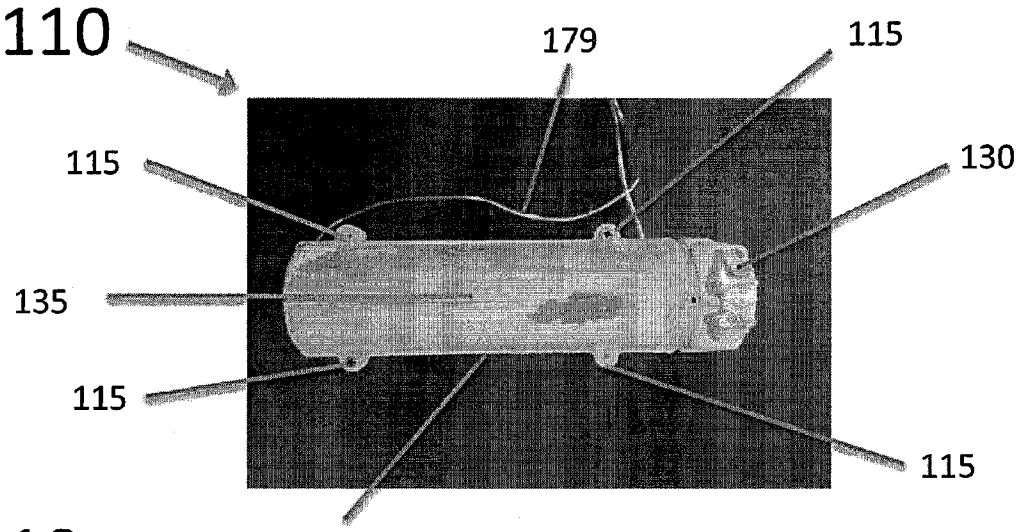
FIG. 6 is a side view of an example water-proof battery capsule.
Figure 7:
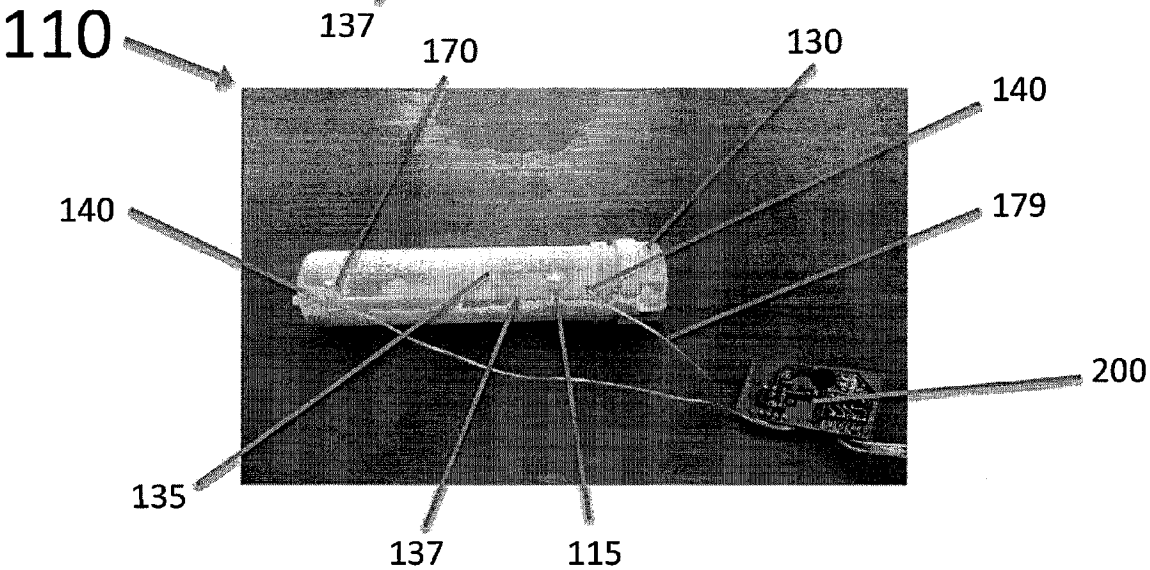
FIG. 7 is a side view of the example water-proof battery capsule.

FIGS. 6 and 7 show the water-proof battery capsule 110 by itself. In this example, it is cylindrically shaped because the ornament is spherical, although the capsule 110 can be any number of shapes. Its shape will conform to the shape of the ornament within which it is housed. Generally, the same water resistant material used for the ornament surface 160 is used for the battery capsule 110, although this need not be the case as they each merely need to be made of a suitable water resistant material. Screws are typically used in the battery capsule lock clasps 115 to join the two halves of the capsule together. The capsule tube half indicator 137 protrudes slightly from the capsule surface. The electrical wire 179 accesses the battery pack features within the capsule 110 through the capsule wire apertures 140. Each capsule generally has two such capsule wire apertures 140, one for each battery pack charge.

Figure 8:
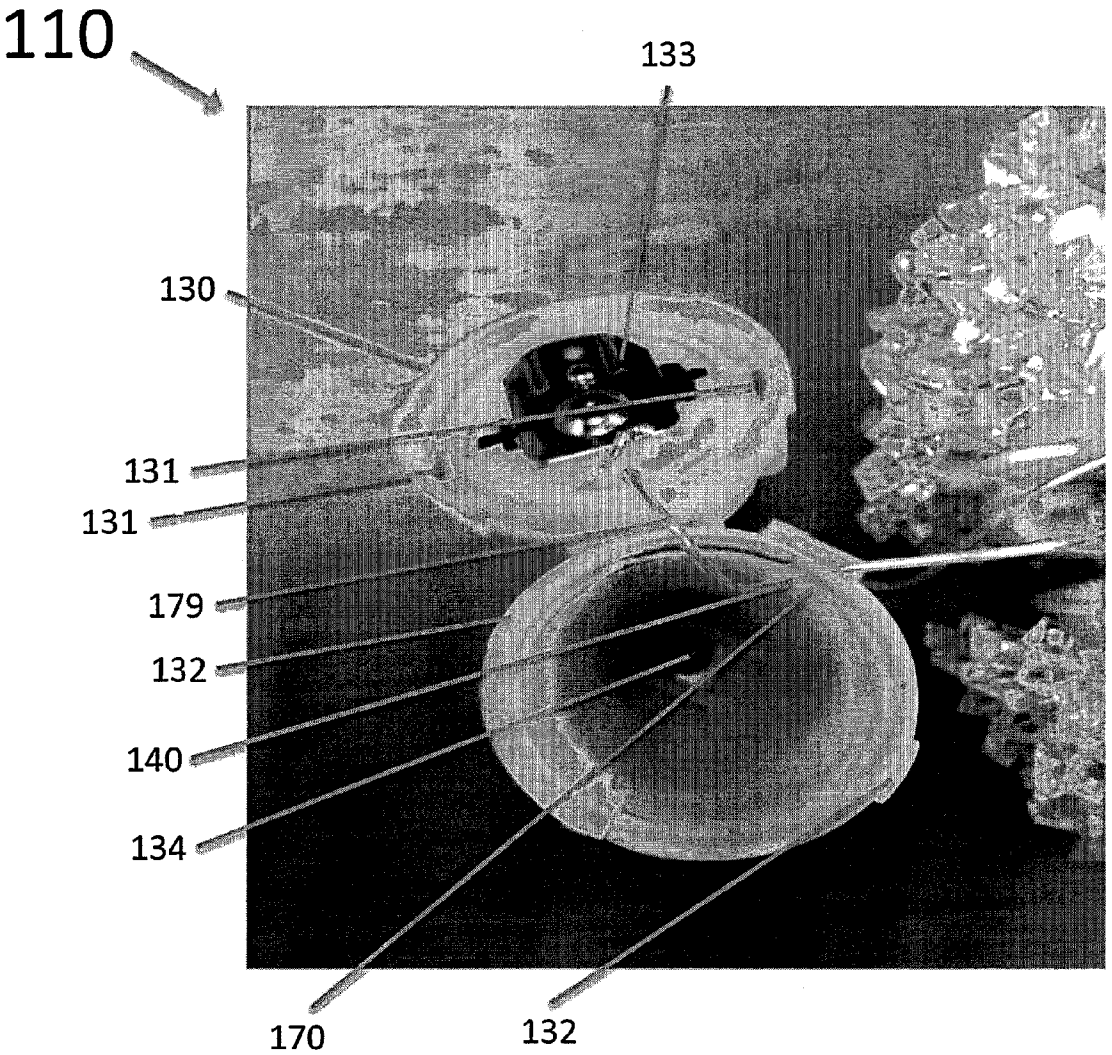
FIG. 8 is a top view of the water-proof battery capsule in an open arrangement.
Figure 9:
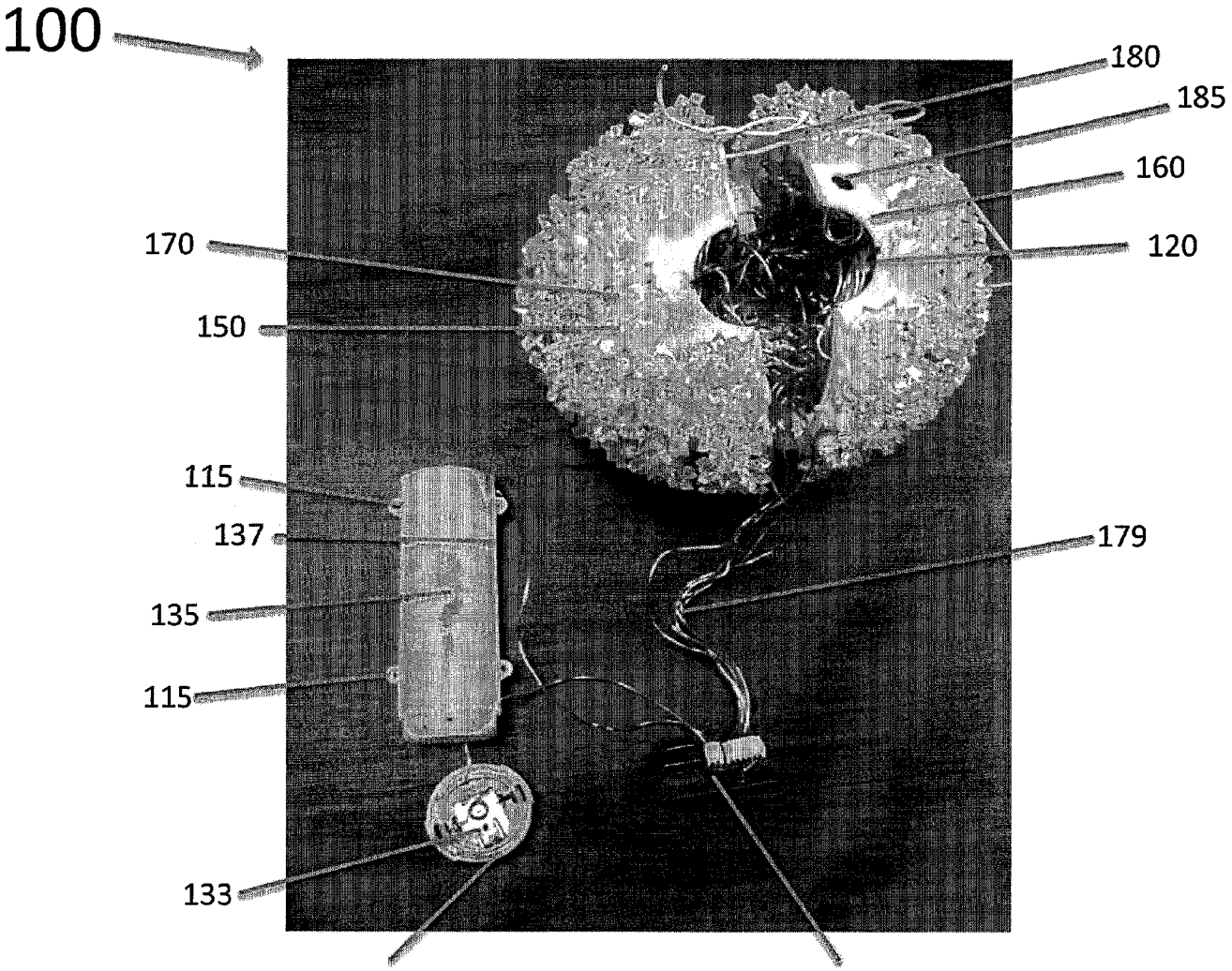
FIG. 9 is a top view of the example spherical ornament in a partially open arrangement showing all of its components.

FIG. 8 shows the capsule 110 with its lid 130 open. In one embodiment, the lid 130 is secured onto the capsule tube 135 by twisting the lid 130 in a clockwise direction such that the lid lock 132 fits into the lid lock aperture 131. The electrical wire 179 is routed from the circuit board 200 through the capsule wire aperture 140 and finally to the positive battery pack terminal 133. The positive battery pack terminal 133 receives from the battery pack a positive charge and sends this charge to the circuit board 200 and then to the plurality of light bulbs 170. Likewise, a negative battery charge is received from the battery pack via the negative battery pack terminal 134 and then sent via the electrical wire 179 to the light bulbs 170. FIG. 9 shows all of the components of the invention together. The mode functionality is provided by a suitable electronic circuit inside the unit.

Although the description here highlights a spherical embodiment of the invention, generally the present invention can employ any number of decorative ornament shapes and sizes. In each instance, a water-proof battery capsule, comprising a battery pack enabling multitude of lighting mode configurations, is enclosed within the hollow shell of the ornament where the size of the capsule is such that it fits within the ornament and such that its lid (or whichever portion is exterior to the ornament) visually complements and conforms to the ornament's shape.

While the above specification and example provide a description of the invention, many embodiments of the invention can be made without departing from the spirit and scope of the invention. It is to be understood that the foregoing embodiment is provided as illustrative only, and does not limit or define the scope of the invention. Various other embodiments are also within the scope of the claims.

I claim:

1. A decorative ornament illuminated by a plurality of light bulbs across its surface, the ornament comprising a water-proof battery capsule housed inside a hollow shell of the ornament, a portion of the capsule being visible externally to the ornament, wherein:

the water-proof battery capsule houses a battery pack providing power when equipped with batteries; and the externally visible portion of the water-proof battery capsule is substantially contiguous with the surface of the decorative ornament; and the ornament comprises outwardly extending apertures placed symmetrically along the entirety of the ornament's axis such that a string or wire can be used to suspend the ornament from any such aperture.

2. The ornament of claim 1, wherein the ornament comprises a plurality of modes each involving a method of display by the plurality of light bulbs.

3. The ornament of claim 1, wherein the hollow shell of the ornament further houses a circuit board used to route current from the battery pack to the plurality of light bulbs.

4. The ornament of claim 1, further comprising apertures and/or pegs placed symmetrically along the ornament's axis used to fasten and align the two halves of the ornament while in a closed arrangement.

5. The ornament of claim 1, wherein the ornament is further provided with translucent member decorations and which receive illumination from the light bulbs.

6. The ornament of claim 1, wherein the ornament comprises a full-on mode where the light bulbs are on and not blinking.

7. The ornament of claim 1, wherein the ornament comprises a blinking-on mode where the light bulbs turn off and on after a fixed amount of time.

8. The ornament of claim 1, wherein the ornament comprises a timer mode where the light bulbs are set to turn off from full-on or blinking-on mode after a set time or set amount of time.

9. The ornament of claim 1, further comprising a wire both to suspend the ornament and to fasten the ornament's halves together in a closed arrangement.

10. An apparatus, comprising a decorative ornament illuminated by a plurality of light bulbs across its surface, the ornament comprising a water-proof battery capsule housed inside a hollow shell of the ornament, a portion of the capsule being visible externally to the ornament wherein:

the water-proof battery capsule houses a battery pack providing power when equipped with batteries; and the externally visible portion of the water-proof battery capsule is substantially contiguous with the surface of the decorative ornament; and the ornament comprises outwardly extending apertures placed symmetrically along the entirety of the ornament's axis such that a string or wire can be used to suspend the ornament from any such aperture.

11. The apparatus of claim 10, wherein the ornament comprises a plurality of modes each involving a method of display by the plurality of light bulbs.

12. The apparatus of claim 10, wherein the hollow shell of the ornament further houses a circuit board used to route current from the battery pack to the plurality of light bulbs.

13. The apparatus of claim 10, further comprising apertures and/or pegs placed symmetrically along the ornament's axis used to fasten and align the two halves of the ornament while in a closed arrangement.

14. The apparatus of claim 10, wherein the ornament is further provided with translucent member decorations and which receive illumination from the light bulbs.

15. The apparatus of claim 10, wherein the ornament comprises a full-on mode where the light bulbs are on and not blinking.

16. The apparatus of claim 10, wherein the ornament comprises a blinking-on mode where the light bulbs turn off and on after a fixed amount of time.

17. The apparatus of claim 10, wherein the ornament comprises a timer mode where the light bulbs are set to turn off from full-on or blinking-on mode after a set time or set amount of time.

18. The apparatus of claim 10, further comprising a wire both to suspend the ornament and to fasten the ornament's halves together in a closed arrangement.

19. A decorative ornament illuminated by a plurality of light bulbs across its surface, the ornament comprising a water-proof battery capsule housed inside a hollow shell of the ornament, a portion of the capsule being visible externally to the ornament wherein:

the water-proof battery capsule houses a battery pack providing power when equipped with batteries; and the ornament further comprises translucent member decorations across its surface for enhancing an illuminative effect of the light bulbs; and the externally visible portion of the water-proof battery capsule is substantially contiguous with the surface of the decorative ornament; and the ornament comprises outwardly extending apertures placed symmetrically along the entirety of the ornament's axis such that a string or wire can be used to suspend the ornament from any such aperture.

20. The ornament of claim 19, wherein the ornament is in the shape of a spherical ball.

* * * * *